US006770877B2

(12) United States Patent
Ohta et al.

(10) Patent No.: US 6,770,877 B2
(45) Date of Patent: Aug. 3, 2004

(54) METHOD AND APPARATUS FOR ANALYZING VAPORS GENERATED FROM EXPLOSIVES

(75) Inventors: Toshihiko Ohta, Taketoyo (JP); Kenji Kusumoto, Taketoyo (JP); Yasuaki Takada, Kiyose (JP); Hisashi Nagano, Hachioji (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/457,426

(22) Filed: Jun. 10, 2003

(65) Prior Publication Data

US 2004/0113067 A1 Jun. 17, 2004

(30) Foreign Application Priority Data

Jun. 21, 2002 (JP) ..... 2002-180705

(51) Int. Cl.[7] ..... H01J 49/10
(52) U.S. Cl. ..... 250/288
(58) Field of Search ..... 250/288, 281, 250/282

(56) References Cited

U.S. PATENT DOCUMENTS 5,175,431 A * 12/1992 Eisele et al. ..... 250/288
6,483,108 B1 * 11/2002 Sakairi ..... 250/288

* cited by examiner

*Primary Examiner*—Kiet T. Nguyen
(74) *Attorney, Agent, or Firm*—Antonelli, Terry, Stout & Kraus, LLP

(57) ABSTRACT

A method and apparatus for analyzing vapors generated from explosives in which vapors containing nitrogen monoxide and/or nitrogen dioxide are generated by decomposing explosives by increasing the temperature of the explosives, primary ions and neutral molecules are generated from air. The generated primary ions and the nitrogen monoxide and/or nitrogen dioxide contained in the generated vapors are allowed to react with each other in an area inhibited or prevented from being penetrated by the generated neutral molecules, and the nitrogen monoxide and/or nitrogen dioxide contained in the generated vapors is ionized. The ionized nitrogen monoxide and/or nitrogen dioxide is subjected to mass spectrometry, and an amount of the nitrogen monoxide and/or nitrogen dioxide contained in the generated vapors by decomposing the explosives is determined.

2 Claims, 6 Drawing Sheets

METHOD AND APPARATUS FOR ANALYZING VAPORS GENERATED FROM EXPLOSIVES

BACKGROUND OF THE INVENTION

The present invention relates to a method for analyzing vapors generated from explosives, and an analysis apparatus for use in the method. More specifically, it relates to an analysis method and an analysis apparatus each preferably used for the stability test of an old explosive.

Deterioration of explosives due to secular changes and the like affects the aspect of performances, for example, in such a manner as to make a prescribed explosion power unobtainable. In addition, it increases the fear of causing spontaneous ignition or an incidental explosion accident. The explosives are affected by temperature, humidity, and light, and the speed of deterioration varies according to the storage state. Therefore, for explosives, it is difficult to understand the degree of its deterioration only by the length of time elapsed after manufacturing.

Conventionally, at the site of manufacturing and storage of explosives, examination of deterioration of explosives is carried out by the Abel heat test method. Below, a description will be given to the Abel heat test method adopting an explosive containing nitrate ester as an example by reference to FIGS. 9 and 10.

FIG. 9 is a schematic diagram of an apparatus 90 for carrying out the Abel heat test. A reference numeral 91 denotes a container for containing therein prescribed-temperature hot water. The container 91 includes a test tube 92 for filling therein an analysis sample, and a thermometer 93 for determining the bath hot water temperature. On the other hand, FIG. 10 is a schematic diagram for illustrating the test tube 92. The upper part of the test tube 92 is attached with a rubber stopper 94 including a glass rod 94*a*. The lower end of the glass rod 94*a* is provided with a potassium iodide starch paper 94*c* suspended from a platinum wire 94*b* in the form of key.

The Abel heat test method is carried out by means of the apparatus shown in FIGS. 9 and 10 in the following manner. First, a proper amount of the sample is collected into the test tube 92 as it is when the explosive containing nitrate ester of the sample is in granular form, or in small pieces when it is a large-size explosive in square, band, or string form or other form (not shown). When the sample has taken up moisture, previously, it is sufficiently dried by vacuum drying or the like at ordinary temperature, and then collected into the test tube 92. Subsequently, the test tube 92 is stopped by the rubber stopper 94 including the glass rod 94*a* having the test paper 94*c*. At this step, the upper half part of the test paper 94*c* is dampened with a half-and-half mixed solution of distilled water and glycerin. Subsequently, the test tube 92 is set in the apparatus 90 as shown in FIG. 9. Herein, a marked line 92*a* given on the test tube 92 in FIG. 10 denotes the critical position of the hot water bath upper surface when the test tube 92 is set in the apparatus 90, a marked line 92*b* denotes the actual hot water bath upper surface position, and a marked line 92*c* denotes the position at a height ⅓ of the height of the test tube 92. Whereas, in the container 91, a prescribed amount of prescribed-temperature, generally 65° C. bath hot water is previously charged.

The analysis is carried out in the following manner. The test tube 92 is mounted at a prescribed position of the apparatus 90, and then, the length of time elapsed until the color tone with the same density as that of a standard paper occurs at the dry-wet boundary portion of the test paper 94*c* is determined. This determined time is taken as the heat resistant time, so that the deterioration states of explosives are determined according to this time.

Such a prior-art Abel heat test method has the following problems.

First, in the deterioration processes of explosives, predictably, there are present a process in which the explosives decompose while releasing nitrogen monoxide (NO) and a process in which the explosives decompose while releasing nitrogen dioxide ($NO_2$). However, with the Abel heat test method, the amount of $NO_2$ is determined, and hence sufficient attention has not been paid to NO. Further, in the determination of $NO_2$ in the Abel heat test method, the criterion for deterioration is the value as very high as 200 ppm, so that the sensitivity is too low to examine the stability of the explosive in details. Still further, the analysis is carried out by a sensory test in which the color of the test paper in the test tube is visually judged. For this reason, another problem is unfavorably encountered that the differences in experience, color and temperature of the laboratory light source, and the like cause differences in results.

On the other hand, various methods have been used for general-purpose analysis of a chemical substance Among them, the mass spectrometry is known as an analysis method excellent in sensitivity and selectivity. With the mass spectrometry, ionization of a sample is required-for achieving the separation depending upon the mass to charge ratio (m/z). As the general-purpose ionization processes, mention may be made of: (a) a process by electron impact in a vacuum; (b) a process by the chemical reaction of primary ions and sample molecules; (c) a process utilizing the tunnel effect of electrons by an electric field; and (d) a process by impacts of neutral atoms at a solid phase interface.

The process (a) is excellent in ease of use and also in reproducibility. With the process (b), a difference in sensitivity is caused from one kind to another of samples according to the reactivity with the primary ions. With the process (c), a large amount of a sample is required, and further, the apparatus increases in size. With the process (d), a sample is easy to prepare, which enables the analysis of a high boiling sample.

However, these processes (a) to (d) are not necessarily sufficient for ionizing a vapor sample generated from explosives in a general manner.

In general, in order to identify a specific substance in a vapor mixture, the specific substance is required to be separated from the vapor mixture. As such a separation process, for example, gas chromatography/mass spectrometry (below, abbreviated as GC/MS) is known. This process is a system in which a specific substance is separated from a vapor mixture by GC, and analyzed by MS. However, with this process, a long time is taken for analysis, and hence it is difficult to continuously monitor the state of deterioration with time. In addition, operation and maintenance are required to be performed using a reference material at all times. Other analysis processes also present the same problems when using a separation means.

SUMMARY OF THE INVENTION

It is an object of the present invention to provide a method for analyzing vapors generated from explosives, capable of collecting a sample with ease, and stably analyzing the vapors generated from explosives in a short time and with high accuracy.

It is another object of the present invention to provide an apparatus for analyzing vapors generated from explosives, capable of analyzing the vapors generated from explosives in a short time and with high accuracy, and also capable of being reduced in size.

In accordance with the present invention, there is provided a method for analyzing vapors generated from explosives, which comprises: a step (1) of generating vapors from explosives; a step (2) of generating primary ions and neutral molecules from air; a step (3) of allowing the primary ions generated in the step (2) and an analysis target sample contained in the vapors generated in the step (1) to react with each other in an area inhibited or prevented from being penetrated by the neutral molecules generated in the step (2), and ionizing the sample; and a step (4) of subjecting the sample ionized in the step (3) to mass spectrometry.

In the step (1), as a process for generating vapors from explosives, for example, mention may be made of a process in which the explosives are heated to a desired temperature. The vapors to be generated include decomposition products from the explosives, for example, analysis target samples such as NO and $NO_2$.

Herein, examples of the explosives which decompose to release NO and $NO_2$ may include nitroglycol, nitroglycerin, pentaerythritol tetranitrate, trinitrotoluene, nitrocellulose, cyclotrimethylenetrinitroamine, and 2,4,6-trinitrophenylnitroamine. These explosives may be employed alone, or in mixture of two or more kinds thereof for use. Further, it is also possible to use explosives including other materials mixed therein.

The step (2) can be carried out, for example, in the following manner. A high voltage is applied to a needle electrode, so that a corona discharge is caused in the vicinity of the tip of the needle electrode. By the corona discharge, primary ions such as oxygen ions and neutral molecules of NO and the like are generated from air.

The step (3) is a step of allowing the primary ions generated in the step (2) and the analysis target sample contained in the vapors generated in the step (1) to react with each other, and ionizing the sample. In this step, if the vapors generated in the step (1) and the primary ions and the neutral molecules generated in the step (2) are allowed to react with each other in the same area, the high-accuracy analysis thereof becomes difficult. The reason for this is that it is not possible to distinguish the NO as the analysis target sample present in the vapors generated from explosives in the step (1) from the NO as the neutral molecules generated in the step (2).

Therefore, in the step (3) in the analysis method of the present invention, it is necessary to effect the reaction between the primary ions generated in the step (2) and the analysis target sample contained in the vapors generated in the step (1) in an area shielded from penetration of the neutral molecules generated in the step (2).

As a process for shielding the area from the neutral molecules, for example, mention may be made of the following process. As shown in FIG. 3 described later, the layout of an exhaust system is appropriately selected so that the neutral molecules can be inhibited or prevented from penetrating into the area where the primary ions and the analysis target sample react with each other. Thus, the flow of vapors generated in the step (1) and the flow of the neutral molecules are controlled. In addition, the reaction between the primary ions and the analysis target sample is effected by an atmospheric pressure ionization process. With such an atmospheric pressure ionization process, it is possible to continuously monitor the substances in the vapors, which enables the vapor components to be ionized in a short time and in a simple manner.

In the step (4), the mass spectrometry has no particular restriction. For example, the step (4) can be accomplished by a mass spectrometry employing a mass analyzer using a permanent magnet, a quadrupole mass analyzer, an ion trap mass analyzer, or the like.

Further, in accordance with the present invention, there is provided an apparatus for analyzing. vapors generated from explosives, which comprises: a vapor generating means for generating vapors from explosives; an atmospheric pressure ionization means for ionizing an analysis target sample contained in the vapors generated from the vapor generating means; and an analysis means for subjecting an ion sample obtained by the atmospheric pressure ionization means to mass spectrometry, characterized in that the atmospheric pressure ionization means includes a corona discharge unit for generating primary ions and neutral molecules; and an ionization reaction region for allowing the primary ions generated by the corona discharge unit and the analysis target sample to react with each other, and further includes a neutral molecule penetration inhibiting means for inhibiting or preventing the penetration of neutral molecules generated by a corona discharge in the ionization reaction region.

DETAILED DESCRIPTION OF THE PREFERRED EMBODIMENTS

Below, an analysis method and an analysis apparatus of the present invention will be described in more details by reference to the accompanying drawings. However, the present invention is by no way limited to the examples of the drawings.

Figure 1:
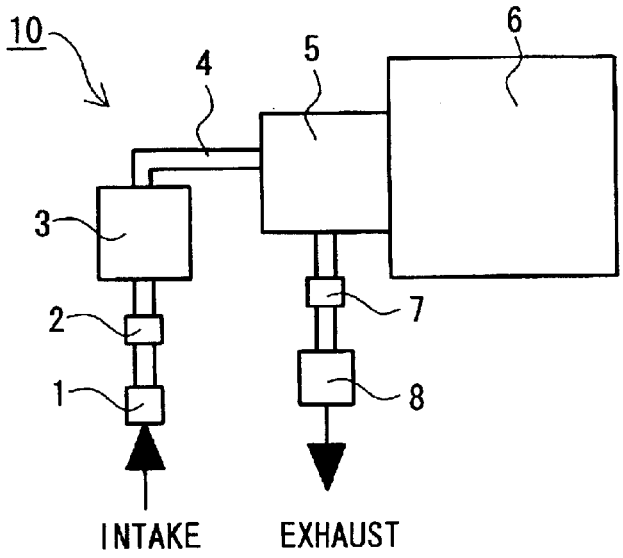
FIG. 1 is a schematic diagram for illustrating one example of an analysis apparatus of the present invention to be used for an analysis method of the present invention.

FIG. 1 is a schematic diagram for illustrating one example of the analysis apparatus of the present invention to be used for the analysis method of the present invention.

An analysis apparatus 10 includes a gas generator 3 for generating vapors from explosives, an ion source 5 as an atmospheric pressure ionization means for ionizing an analysis target sample, and a mass spectrometer 6 for analyzing the mass of the ionized sample.

As shown in FIG. 1, to the gas generator 3, an intake probe 1 for the intake of air and the like, and a flow controller 2 for controlling the flow of the drawn gas are connected. The gas generator 3 and the ion source 5 are connected through a gas introduction pipe 4. To the ion source 5, an exhaust pump 8 for exhausting a part of the gas in the ion source 5 is connected. In the example of FIG. 1, a measuring meter 7 capable of measuring the flow rate of the gas exhausted from the ion source 5 in a confirmative fashion is connected between the ion generator 5 and the exhaust pump 8.

The air passed through the exhaust pump 8 is discharged to a laboratory or the like. However, when the amount of gases generated from explosives is large, which may affect the health of the experimenter, desirably, a procedure such as connecting the exhaust port of the intake pump 8 to an exhaust duct or the like is performed to discharge the exhaust gas outside.

Figure 2:
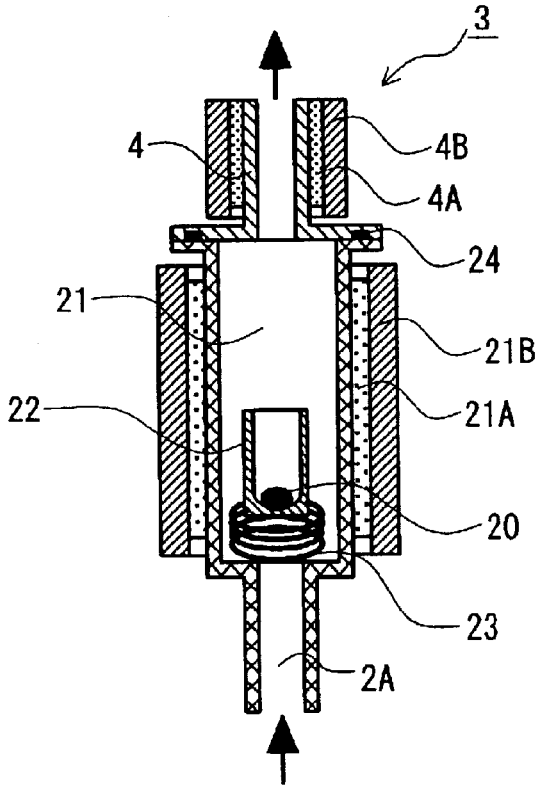
FIG. 2 is a schematic diagram for illustrating one example of a configuration of a gas generator 3 in FIG. 1.

FIG. 2 is a schematic diagram for illustrating one example of a configuration of the gas generator 3 in FIG. 1.

The gas generator 3 includes a gas generating chamber 21 to which a pipe 2*a* for the intake of air and the gas introduction pipe 4 for introducing a gas to the ion source 5 are connected, and a stainless container 22 for mounting thereon explosives 20 as a sample provided in the gas generating chamber 21.

Around the gas generating chamber 21, there are provided a heater 21*a* and a heat insulating material layer 21*b* in order to keep the inside of the chamber 21 at a desirable temperature. On the wall surface, there is mounted a thermocouple (not shown) capable of temperature control by controlling the output from the heater 21*a* while monitoring the temperature inside the chamber 21.

The container 22 for mounting the explosives 20 thereon is fixed inside the gas generating chamber 21 by a container holder 23.

Around the gas introduction pipe 4 connected to the gas generating chamber 21, there are provided a heater 4*a* and a heat insulating material layer 4*b* in order to keep the inside of the pipe 4 at a desirable temperature. Whereas, at the combining site of the gas generating chamber 21 and the gas introduction pipe 4, there is mounted an O ring 24 for keeping the hermeticity.

In order to generate vapors from the explosives 20 in the gas generator 3, first, the explosives 20 as a sample is mounted in the container holder 23. Then, by controlling the inside of the gas generating chamber 21 at a desirable temperature by the heater 21*a*, it is possible to generate vapors containing an analysis target sample from the explosives 20.

On the other hand, the air to be drawn by the intake probe 1 is controlled in flow rate to a desirable amount by the flow controller 2, and sent into the gas generating chamber 21. It is then mixed with the vapors generated from the explosives 20, and sent to the gas introduction pipe 4.

Herein, it is possible to appropriately determine the flow rate of air, and the temperature of the inside of the gas generating chamber 21 and the inside of the gas introduction pipe 4 according to the kind and the form of the explosives, and further, the kind of the analysis target sample, and the like. For example, mention may be made of the case where the flow rate of air into the gas generating chamber 21 is set at 2 l/min, the temperature of the wall surface of the gas generating chamber 21 is set at 40° C., and the wall surface temperature of the gas introduction pipe 4 is set at 180° C.

Figure 3:
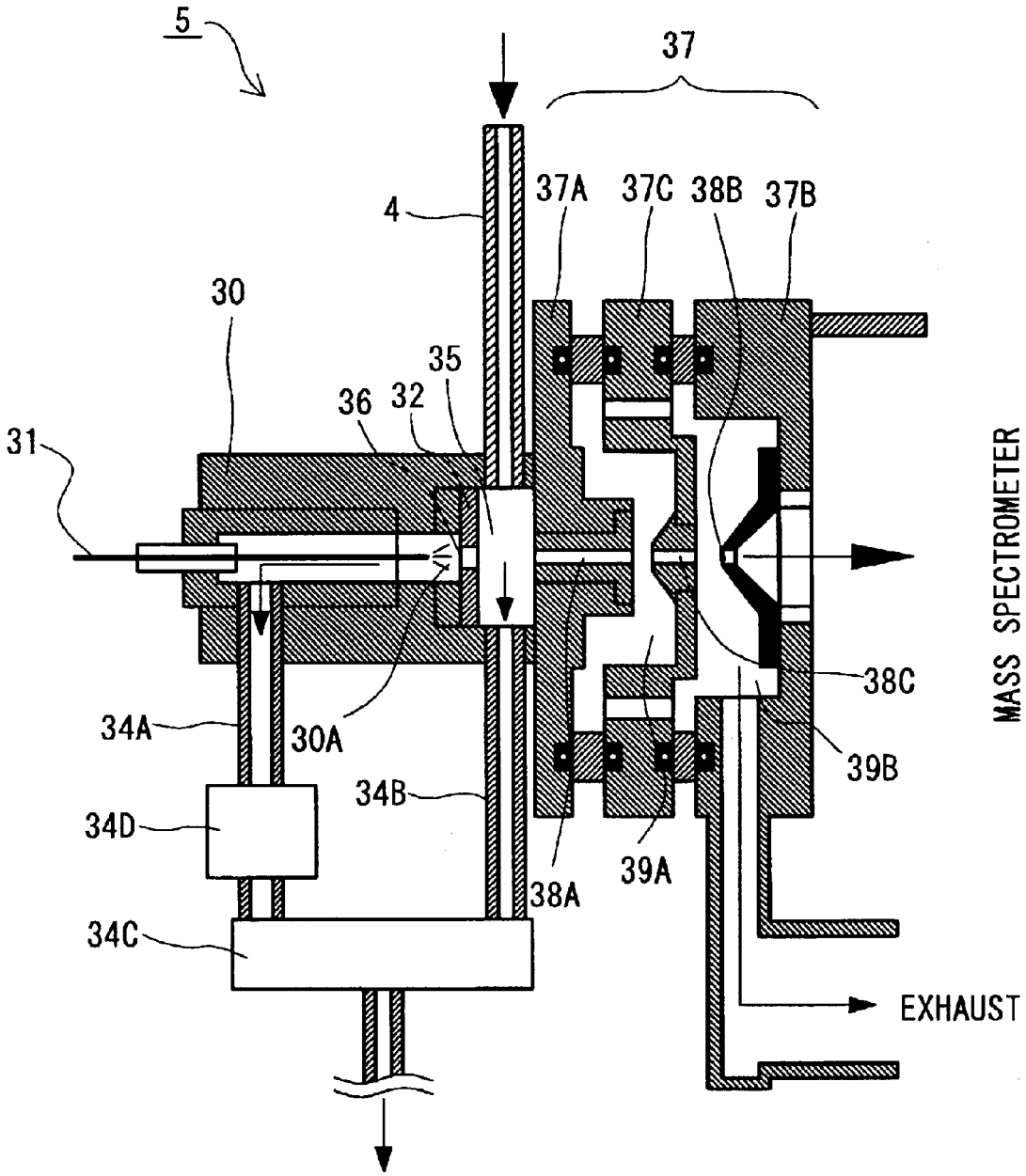
FIG. 3 is a schematic diagram for illustrating one example of a configuration of an ion source 5 in FIG. 1.

FIG. 3 is a schematic diagram for illustrating one example of the configuration of the ion source 5 in FIG. 1.

The ion source 5 includes a needle electrode 31 and a counter electrode 32 for causing a corona discharge, and includes an ion source holder 30 having an ionization reaction area 30*a* for allowing primary ions and the analysis target sample to react with each other, a gas flow space 35 capable of supplying vapors containing the analysis target sample to the ionization reaction area 30*a*, and an ionized sample transport part 37 for introducing the ionized sample generated in the ionization reaction area 30*a* to the mass spectrometer 6.

The ionization reaction area 30*a* of the ion source holder 30 communicates with the gas flow space 35 through an aperture 36. The ion source holder 30 includes an exhaust pipe 34*a* for exhausting the neutral molecules generated by the corona discharge and the gases containing vapors introduced from the gas flow space 35. On the other hand, to the gas flow space 35, the gas introduction pipe 4 for introducing the vapors containing the analysis target sample from the gas generator 3 shown in FIG. 2 is connected. Further, the gas flow space 35 has an exhaust pipe 34*a* for exhausting the vapors. The exhaust pipes (34*a* and 34*b*) are respectively connected to an intake pump 34*c*. Between the exhaust pipe 34*a* and the intake pump 34*c*, a measuring meter 34*d* capable of measuring the flow rate of the vapors discharged from the ion source holder 30 in a confirmative fashion is connected.

The ionized sample transport part 37 includes apertured electrodes (37*a* and 37*b*), and an intermediate electrode 37*c*. A differential pumping region 39*a* is formed between the apertured electrode 37*a* and the intermediate electrode 37*c*. Whereas, a space 39*b* communicating with the gas exhaust pipe is formed between the intermediate electrode 37*c* and the apertured electrode 37*b*.

The apertured electrode 37*a* has an aperture 38*a* connecting with the gas flow space 35. The intermediate electrode 37*c* has an aperture 38*c* for establishing a communication between the differential pumping region 39*a* and the gas exhaust space 39*b*. The apertured electrode 37*b* has an aperture 38*b* for introducing the ion sample to the mass spectrometer 6.

Then, the operation and the function in the ion source 5 will be described.

By applying a high voltage between the needle electrode 31 and the counter electrode 32 in the ion source 5, a corona discharge is generated in the vicinity of the tip of the needle electrode 31. As a result, nitrogen, oxygen, water vapor, and the like are ionized. These ions are referred to as primary ions. The primary ions moves toward the counter electrode 32 by an electric field. On the other hand, the vapors containing the analysis target sample flow toward the ionization reaction area 30*a* through the aperture 36 provided in the counter electrode 32 from the gas flow space 35. Then, the primary ions and the analysis target sample are allowed to react with each other in the area 30*a* to form an ion sample. At this step, a part of the primary ions may pass through the aperture 36 to react with the analysis target sample in the gas flow space 35. However, such a reaction is irrelevant to the reaction with the neutral molecules described later, and hence will not affect the analysis.

By causing a potential difference of, for example, about 1 kV between the counter electrode 32 and the apertured electrode 37*a*, the formed ion sample is caused to move in the direction of the apertured electrode 37*a*, and introduced into the differential pumping region 39*a* through the aperture 38*a*. Adiabatic expansion occurs at the differential pumping region 39*a*, so that solvent molecules and the like are deposited on the ion sample. As a result, so-called clustering may occur. In order to reduce the clustering, it is desirable to heat the apertured electrodes (37*a* and 37*b*) by a heater or the like. In the example shown in FIG. 3, the intermediate electrode 37*c* having the aperture 38*c* is provided between the apertured electrodes (37*a* and 37*c*), so that the pressure of the differential pumping region 39*a* is controlled by the intermediate electrode 37*c* to reduce the difference in pressure between the opposite ends of the aperture 38*a*. This can reduce clustering.

The ion sample passed through the apertures 38*a* and 38*c* is introduced to the mass spectrometer 6 through the aperture 38*b* provided in the apertured electrode 37*b*.

Then, the flow of a gas in FIG. 3 will be described.

The primary ions generated by the corona discharge due to the needle electrode 31 and the counter electrode 32 move toward the counter electrode 32. However, the vapors from the gas flow space 35 flows in the direction of the needle electrode 31 from the counter electrode 32, and hence the neutral molecules of NO and the like generated by the corona discharge are exhausted outside through the exhaust pipe 34*b* by the flow of the gas before reaching the ionization reaction area 30*a*. Further, excess vapors in the gas flow space 35 are also exhausted outside through the exhaust pipe 34*b*. Herein, even when a part of the excess vapors in the gas flow space 35 flow toward the mass spectrometer 6 through the aperture 38*a*, they are exhausted and removed from the differential pumping region 39*a* and the space 39*b*. This can prevent the introduction of such vapors into the mass spectrometer.

As described above, the neutral molecules generated by the corona discharge are inhibited or prevented from penetrating into the ionization reaction area 30*a* where the primary ions and the analysis target sample are allowed to react with each other by the neutral molecule penetration inhibiting means composed of the gas flow space 35, the aperture 36, the exhaust pipes (34*a* and 34*b*), and the intake pump 34*c*. Further, the excess vapors are also inhibited from penetrating into the mass spectrometer 6 as described above. Therefore, it is possible to transport the objective ion sample to the subsequent mass spectrometer 6 with high efficiency.

Figure 4:
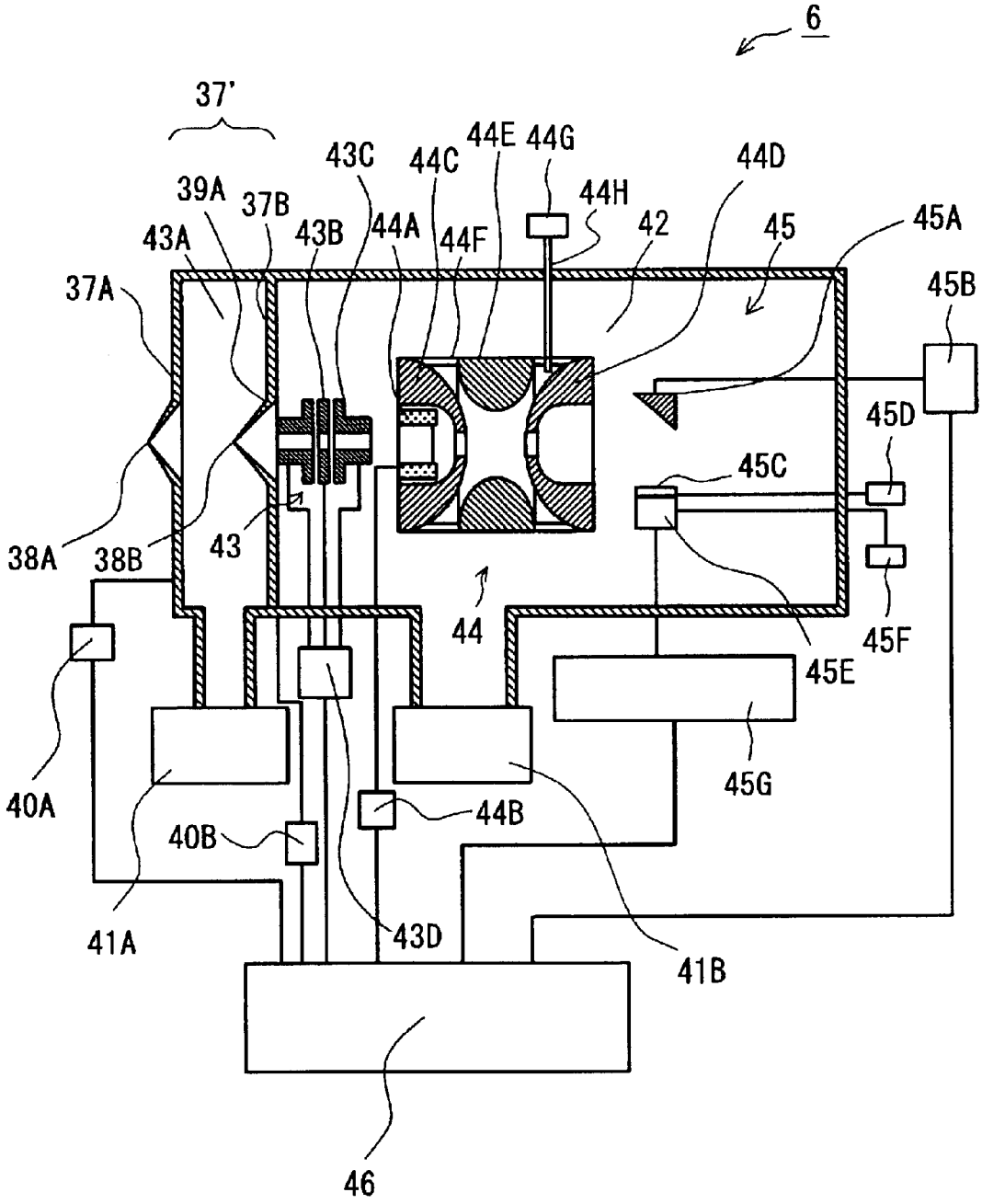
FIG. 4 is a schematic diagram for illustrating one example of a case where a mass spectrometer having an ion trap mass analyzer is used as a mass spectrometer 6 in FIG. 1.

FIG. 4 is a schematic diagram for illustrating one example where a mass spectrometer having an ion trap mass analyzer is used as the mass spectrometer 6 in FIG. 1. In the mass spectrometer for use in the present invention, other than the example of FIG. 4, mass spectrometers having various mass analyzers such as a magnetic sector type mass analyzer and a quadrupole mass analyzer can also be used effectively.

In FIG. 4, a reference numeral 37' denotes an ionized sample transport region showing another example of the ionized sample transport region 37 shown in FIG. 3, and includes apertured electrodes (37*a* and 37*b*) having apertures (38*a* and 38*b*) for introducing the ionized sample to the mass spectrometer 6, and a differential pumping region 39*a*, but does not have the intermediate electrode 37*c*. To the apertured electrode 37*a*, a drift voltage source 40*a* is connected. Whereas, to the apertured electrode 37*b*, an accelerating voltage source 40*b* is connected. Further, the differential pumping region 39*a* is coupled to an exhaust system 41*a*.

The mass spectrometer 6 includes a vacuum region 42 coupled to the exhaust system 41*b*, an ion focusing lens 43 provided in the vacuum region 42, an ion trap mass analyzer 44, and a detector 45, and these components are connected to a control device 46.

The ion focusing lens 43 is a lens for focusing the ion sample introduced into the vacuum region 42, and composed of electrodes (43*a*, 43*b*, and 43*c*) connected to a power source 43*d*.

The mass analyzer 44 includes a gate electrode 44*a* connected to an electrode 44*b*, and end cap electrodes (44*c* and 44*d*) and a ring electrode 44*e*, held by a quartz ring 44*f*. Further, to the mass analyzer 44, a gas supply unit 44*g* for introducing an impact gas such as helium is coupled through a gas introduction pipe 44*h*.

The detector 45 is an apparatus for detecting the ion sample subjected to mass spectrometry at, and discharged from the mass analyzer 44. The detector 45 includes a conversion electrode 45*a* connected to the control device 46 through a conversion electrode power source 45*b*, a scintillator 45*c* connected to a scintillator power source 45*d*, and a photomultiplier 45*e* connected to a photomultiplier power source 45*f*. The photomultiplier 45*e* is connected to the control device 46 through a data processor 45*g*.

The ion sample generated by the ion source is introduced into the vacuum region 42 of the mass spectrometer 6 through the aperture 38*a* opened in the apertured electrode 37*a*, the differential pumping region 39*a* combined to the exhaust system 41*a*, and the aperture 38*b* opened in the apertured electrode 37*b* shown in FIG. 4. For the vacuum region 42, the internal pressure thereof is reduced by the exhaust system 41*b*, and the vacuum state is held. Through application of a voltage to the apertured electrode 37*a* by the drift voltage source 40*a*, it is possible to drift the ion sample captured in the differential pumping region 39*a* in the direct-on of the aperture 37*b*. This enables the improvement of the ion permeability to the aperture 37*b*, In addition, an impact occurs between the gas molecules remaining in the differential pumping region 39*a* and the ion sample, which causes the solvent molecules of water and the like deposited on the ion sample to be separated therefrom.

In the ionized sample transport region 37' in FIG. 4, the accelerating voltage applied to the apertured electrode 37*a* by the accelerating voltage source 40*b* affects the energy (incident energy) when the ion sample passes through the opening provided in the end cap electrode 44*c* of the ion trap mass analyzer 44. The ion confinement efficiency of the mass analyzer 44 depends upon the incident energy of ions. For this reason, the accelerating voltage is preferably set so that the confinement efficiency becomes high.

The ion sample introduced into the vacuum region 42 is converged by the ion focusing lens 43 composed of the electrodes (43*a*, 43*b*, and 43*c*), and then introduced into the mass analyzer 44 while controlling the timing of ion incidence by the gate electrode 44*a*. The ion sample introduced into the mass analyzer 44 is caused to impact with the impact gas such as helium introduced from the gas supply unit 44*g* through the gas introduction pipe 44*h* to be analyzed for the mass.

The ion sample subjected to mass analysis and discharged outside the mass analyzer 44 impacts with the conversion electrode 45*a* applied with the voltage for accelerating the ion sample by the conversion electrode power source 45*b* of the detector 45. By this impact, charged particles are released from the surface of the conversion electrode 45*a*. The charged particles are detected by the scintillator 45*c*, and the signal is amplified by the photomultiplier 45*e*. The detected signal is sent to the data processor 45*g*, and analyzed by the control device 46.

Figure 5:
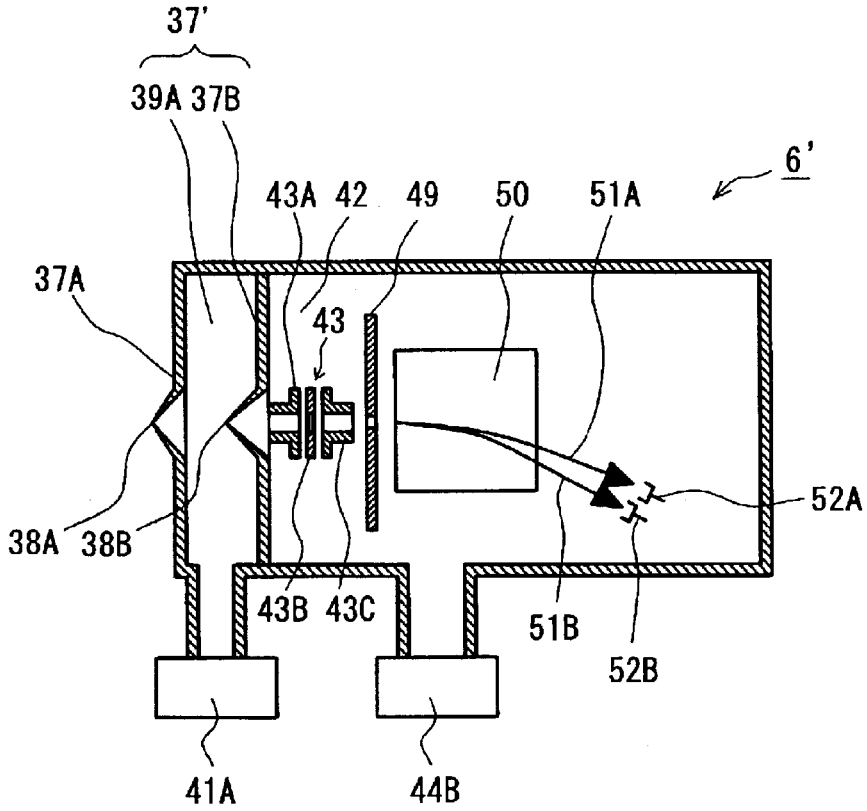
FIG. 5 is a schematic diagram for illustrating another example of a case where a mass spectrometer for separating the orbit of ions having different masses using permanent magnets is used as the mass spectrometer 6 in FIG. 1.

FIG. 5 is a schematic diagram for showing another example of the mass spectrometer. It is an example of a mass spectrometer 6' having a mass analyzer for separating the orbit of ions having different masses using permanent magnets, which is simpler in configuration than the mass spectrometer 6 shown in FIG. 4. Incidentally, throughout the diagrams of the mass spectrometer 6', and the mass spectrometer 6 shown in FIG. 4, the same reference characters and numerals are given to the same configuration, and the description thereon is omitted.

The mass spectrometer 6' shown in FIG. 5 includes a mass analyzer 50 having two permanent magnets (not shown), a slit 49 disposed between the mass analyzer 50 and the ion focusing lens 43, and Faraday cups (52*a* and 52*b*) as ion detectors in the vacuum region 42.

The ion sample focused by the ion focusing lens 43 is further reduced in beam diameter by the slit 49, and then made incident upon the mass analyzer 50. The orbit of the incident sample ion is bent by the static magnetic field at right angles thereto formed by the two permanent magnets of the mass analyzer 50. At this step, a heavy (large-m/z) ion sample and a light (small-m/z) ion sample take mutually different orbits under the influence of the magnetic field. Therefore, as shown in FIG. 5, it is possible to separate the orbit 51*a* of the heavy ion from the orbit 51*b* of the light ion.

The Faraday cups (52*a* and 52*b*) can be positioned in the following manner, for example, when the concentrations of NO and $NO_2$ generated from the explosives are measured. Namely, it is possible to position the Faraday cup 52*a* at the reaching point of ions having a m/z of 62, and to position the Faraday cup 52*b* at the reaching point of ions having a m/z of 46. Thus, by monitoring the signals at the respective Faraday cups, it is possible to measure the concentrations of NO and $NO_2$.

It is possible to manufacture such a mass analyzer using permanent magnets at much lower cost than a quadrupole mass analyzer, an ion trap mass analyzer, or the like. Therefore, the apparatus of the present invention including the mass spectrometer shown in FIG. 5 is suitable for the application in which it is set in a magazine or the like to continuously ascertain the deterioration state of explosives.

Figure 6:
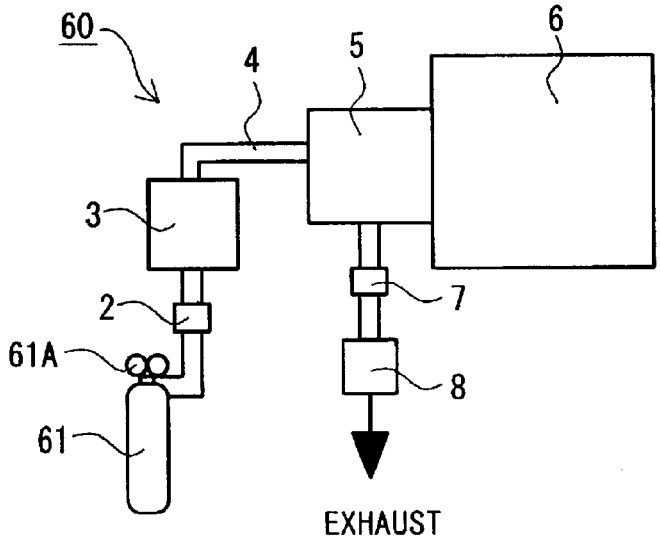
FIG. 6 is a schematic diagram for showing another embodiment of the analysis apparatus in the present invention.

FIG. 6 is a schematic diagram for showing another embodiment of the analysis apparatus in the present invention. An apparatus 60 shown in FIG. 6 is identical in configuration with the apparatus 10 shown in FIG. 1, except for including an air cylinder 61 and a reducing valve 61*a* in place of the intake probe 1.

In the apparatus 60, not the air which may contain NO and $NO_2$ drawn from the intake probe 1 in the apparatus 10 shown in FIG. 1, but clean air from the air cylinder 61 is supplied to the gas generator 3 through the reducing valve 61*a*. This enables the detection of NO or $NO_2$ with a concentration as very low as not more than ppb.

Figure 7:
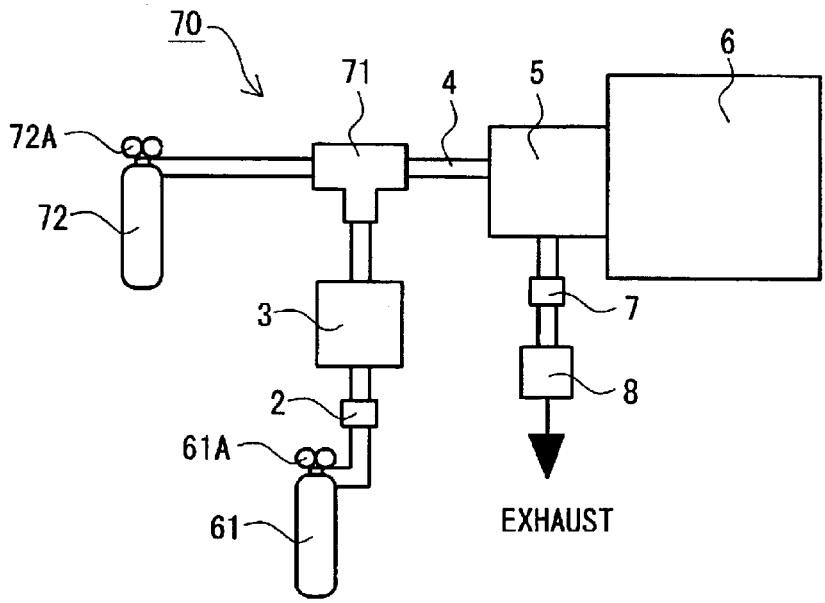
FIG. 7 is a schematic diagram for showing a still other embodiment of the analysis apparatus in the present invention.

FIG. 7 is a schematic diagram of a still other embodiment of the analysis apparatus of the present invention. An apparatus 70 shown in FIG. 7 is identical in configuration with the apparatus 60 shown in FIG.6, except that it is an embodiment in which to the gas introduction pipe 4 in the apparatus 60 shown in FIG. 6, a T connector 71 is mounted, and a reducing valve 72*a* and a standard gas cylinder 72 are connected to the T connector 71.

In the apparatus 70, it is possible to charge a stable isotope-substituted standard gas with a known concentration such as $N^{15}O$ or $N^{15}O_2$ in the standard gas cylinder 72. The standard gas is mixed with the vapors generated from the sample by means of the reducing valve 72*a* and the T connector 71, and then introduced in the ion source 5.

In the apparatus 70, for example, when $N^{15}O$ is used as a standard gas, the $N^{15}O$ reacts with oxygen molecule ions to form $N^{15}O_3^-$. The m/z of the resulting sample is 63. The concentration of the $N^{15}O$ is known. Therefore, by comparison with the ionic strength of normal $N^{14}O_3^-$ observed at m/z: 62, it is possible to determine the concentration of NO generated from the sample more accurately than with the apparatus 60.

Figure 8:
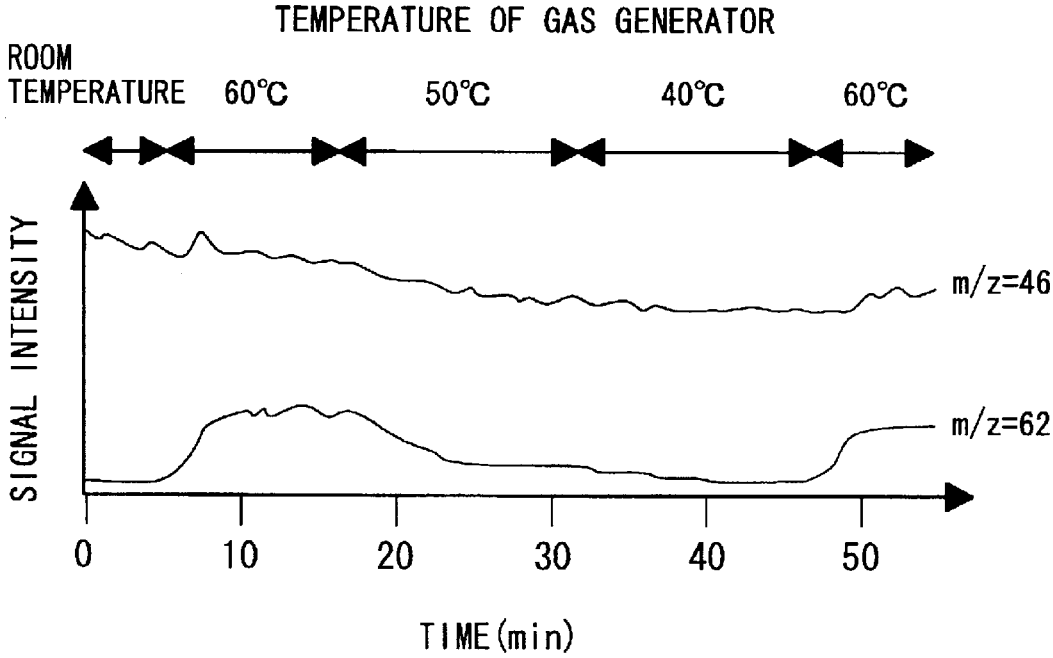
FIG. 8 is a graph for showing the results obtained by measuring a smokeless powder for the relationship between the temperature and the time in the gas generator 3, and the signal intensities for m/z: 46 and 62 using the analysis apparatus of the present invention shown in FIGS. 1 to 4.
Figure 9:
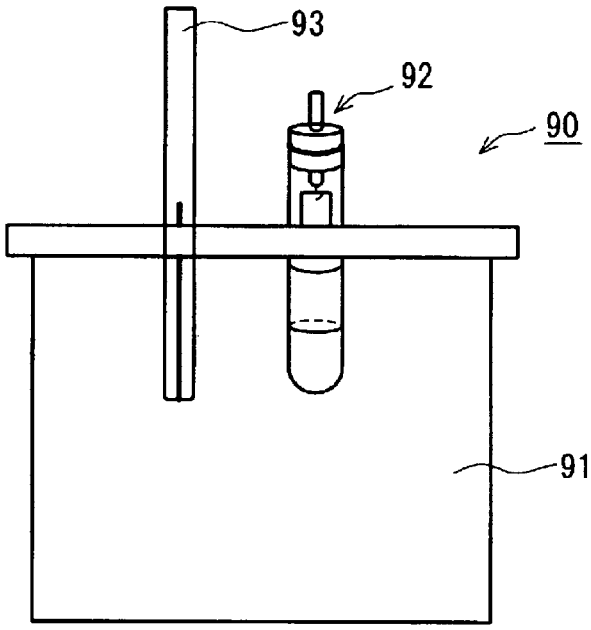
FIG. 9 is a schematic diagram of an apparatus for performing a conventional Abel heat test.
Figure 10:
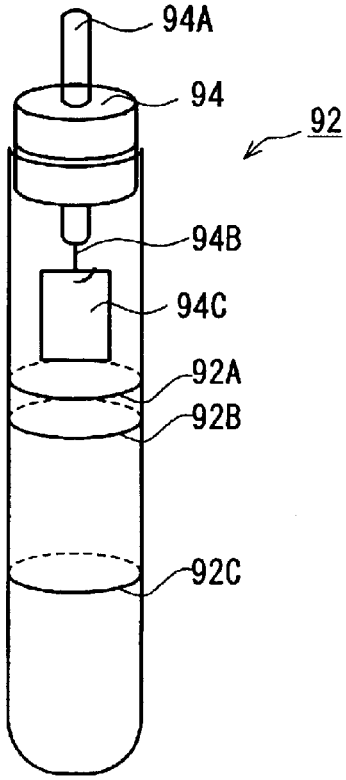
FIG. 10 is a schematic diagram for illustrating a test tube 92 in the apparatus shown in FIG. 9.

FIG. 8 is a graph showing the result obtained by analyzing a smokeless powder mainly composed of nitrocellulose and nitroglycerin for the relationship between the temperature and the time in the gas generator 3 and the signal intensities for m/z: 46 and 62 by means of the analysis apparatus of the present invention shown in FIGS. 1 to 4.

In FIG. 8, the one to be observed at m/z: 46 is $NO_2^-$ obtained by ionizing $NO_2$, while the one to be observed at m/z: 62 is $NO_3^-$ obtained by ionizing NO. The signal intensity plotted as the ordinate is proportional to the concentration of NO or $NO_2$ flowing into the ion source 5. An increase in temperature of the gas generator 3 increases the temperature of the explosives, which causes decomposition. This presumably results in release of NO and $NO_2$ which are decomposition products. However, even if the temperature is raised, the signal for m/z: 46 is not remarkably increased. Therefore, it can be concluded that the observed signal for m/z: 46 is mainly for $NO_2$ contained in air of a laboratory.

On the other hand, in FIG. 8, for m/z: 62, the signal amount changes in accordance with the set temperature of the gas generator. This result has shown that the smokeless powder used as the sample undergoes a decomposition reaction whereby NO is mainly released when under a thermal load.

Thus, by determining the amount of NO or $NO_2$ generated at each temperature, it is possible to evaluate the characteristics and the safeties of the respective explosives.

It is predicted that the process in which the explosives decompose and deteriorate includes the reaction of releasing NO and the reaction of releasing $NO_2$. However, it has been difficult to discriminate between and analyze both the reactions in the prior art. However, the result of FIG. 8 indicates that it is possible to each independently analyze NO and $NO_2$ generated from the explosives in real time by means of the analysis method and the analysis apparatus in the present invention. This respect is very important for the fundamental research of explosives.

The method for analyzing vapors generated from explosives of the present invention particularly comprises: a step (1) of generating vapors from explosives; a step (2) of generating primary ions and neutral molecules from air; a step (3) of allowing the primary ions generated in the step (2) and an analysis target sample contained in the vapors generated in the step (1) to react with each other in an area inhibited or prevented from being penetrated by the neutral molecules generated in the step (2), and ionizing the sample; and a step (4) of subjecting the ion sample obtained in the step (3) to mass spectrometry. Whereas, with the analysis method of the present invention, it is also easy to handle the explosives serving as an analysis sample. Therefore, by utilizing the analysis method of the present invention, it becomes possible to perform the stability test of the explosives with accuracy and promptness. As a result, it is possible to more reduce the risk of accidental explosion or the like.

On the other hand, for the analysis apparatus of the present invention, particularly, the atmospheric pressure ionization means has a neutral molecule penetration inhibiting means for inhibiting or preventing the penetration of neutral molecules generated by a corona discharge into the ionization reaction region. Therefore, it is possible to carry out the analysis method of the present invention with effectiveness. Accordingly, it is possible to analyze NO, $NO_2$, or the like generated from the explosives in a short time, and with high accuracy in real time. In particular, the analysis apparatus can be preferably used for the stability test of explosives during storage.

What is claimed is:

1. A method for analyzing vapors generated from explosives, comprising:

a step (1) of generating vapors containing nitrogen monoxide and/or nitrogen dioxide by decomposing explosives by increasing the temperature of the explosives;

a step (2) of generating primary ions and neutral molecules from air;

a step (3) of allowing the primary ions generated in the step (2) and nitrogen monoxide and/or nitrogen dioxide contained in the vapors generated in the step (1) to react with each other in an area inhibited or prevented from being penetrated by the neutral molecules generated in the step (2), and ionizing nitrogen monoxide and/or nitrogen dioxide contained in the vapors generated in the step (1); and a step (4) of subjecting nitrogen monoxide and/or nitrogen dioxide ionized in the step (3) to mass spectrometry, and determining an amount of nitrogen monoxide and/or nitrogen dioxide generated in the step (1).

2. An apparatus for analyzing vapors generated from explosives, comprising:

a vapor generating means for generating vapors containing nitrogen monoxide and/or nitrogen dioxide by decomposing explosives by increasing the temperature of the explosives;

an atmospheric pressure ionization means for ionizing nitrogen monoxide and/or nitrogen dioxide contained in the vapors generated from the vapor generating means; and an analysis means for subjecting an ion obtained by the atmospheric pressure ionization means to mass spectrometry, wherein the atmospheric pressure ionization means includes a corona discharge unit for generating primary ions and neutral molecules; and an ionization reaction region for allowing the primary ions generated by the corona discharge unit and nitrogen monoxide and/or nitrogen dioxide contained in the vapors generated from the vapor generating means to react with each other, and further includes a neutral molecule penetration inhibiting means for inhibiting or preventing the penetration of the neutral molecules generated by a corona discharge in the ionization reaction region, and wherein an amount of nitrogen monoxide and/or nitrogen dioxide contained in the vapors generated by decomposing the explosives with the vapor generating means is determined.

* * * * *